US008235564B2

(12) United States Patent
Jeong

(10) Patent No.: US 8,235,564 B2
(45) Date of Patent: Aug. 7, 2012

(54) STREET LIGHT WHICH ADOPT XENON LAMP

(76) Inventor: Poong Gi Jeong, Jeonju-si (KR)

( * ) Notice: Subject to any disclaimer, the term of this patent is extended or adjusted under 35 U.S.C. 154(b) by 194 days.

(21) Appl. No.: 12/809,670

(22) PCT Filed: Mar. 7, 2008

(86) PCT No.: PCT/KR2008/001314

§ 371 (c)(1),
(2), (4) Date: Jun. 21, 2010

(87) PCT Pub. No.: WO2009/082058

PCT Pub. Date: Jul. 2, 2009

(65) Prior Publication Data

US 2010/0271803 A1 Oct. 28, 2010

(30) Foreign Application Priority Data

Dec. 21, 2007 (KR) ..... 10-2007-0135839

(51) Int. Cl.
*F21V 33/00* (2006.01)

(52) U.S. Cl. ..... 362/431; 362/361

(58) Field of Classification Search ..... 362/431, 362/361

See application file for complete search history.

(56) References Cited

U.S. PATENT DOCUMENTS

| | | | | |
|---|---|---|---|---|
| 4,384,316 | A * | 5/1983 | de Vos et al. | 362/147 |
| 7,387,409 | B1 * | 6/2008 | Beadle | 362/308 |
| 2007/0209566 | A1 * | 9/2007 | MacDonald et al. | 114/177 |
| 2008/0092794 | A1 * | 4/2008 | MacDonald et al. | 114/173 |

FOREIGN PATENT DOCUMENTS

| | | |
|---|---|---|
| KR | 1998-019412 | 6/1998 |
| KR | 20-0383849 | 5/2005 |
| KR | 10-0641115 | 11/2006 |
| KR | 10-0725577 | 6/2007 |

OTHER PUBLICATIONS

International Search Report—PCT/KR2008/001314 dated Sep. 18, 2008.

* cited by examiner

*Primary Examiner* — Laura Tso
(74) *Attorney, Agent, or Firm* — Cantor Colburn LLP

(57) ABSTRACT

Disclosed is a streetlight having a xenon lamp in that a lamp assembly having a xenon lamp is formed at the existed streetlight, whereby lowering a power consumption and remarkably increasing the period of the lamp change. The present invention is to provide a streetlight having a xenon lamp in that the xenon lamp is formed therein, whereby emitting a lot brighter light with low power consumption. Also, the present invention is to provide a streetlight having a xenon lamp in that a ballast is built in a lamp assembly having the xenon lamp, so that the change of the xenon lamp can be easily performed and the lamp assembly can be easily applied to even the existed streetlight. Moreover, the present invention is to provide a streetlight having a xenon lamp in that a plurality of xenon lamps can be formed at one lamp assembly and the number of each lamp can be controlled, thereby adjusting the brightness thereof and another xenon lamp and ballast can be operated during the damage of the operating xenon lamp, thereby remarkably increasing the period of the lamp change.

11 Claims, 5 Drawing Sheets

STREET LIGHT WHICH ADOPT XENON LAMP

TECHNICAL FIELD

The present invention relates to a streetlight having a xenon lamp and more particularly, to a streetlight having a xenon lamp in that a lamp assembly having a xenon lamp is formed at the existed streetlight, whereby lowering a power consumption and remarkably increasing the period of the lamp change.

BACKGROUND ART

Generally, since there is a limit to the life span of a ballast, the management and the maintenance of a lamp and a ballast are often endeavor and cost consuming.

Accordingly, the ballast having a long period in terms of the maintenance thereof and capable of easily repairing it has been keenly demanded.

DISCLOSURE OF INVENTION

Technical Problem

It is, therefore, an object of the present invention is to provide a streetlight having a xenon lamp in that the xenon lamp is formed therein, whereby emitting a lot brighter light with low power consumption.

Another object of the present invention is to provide a streetlight having a xenon lamp in that a ballast is built in a lamp assembly having the xenon lamp, so that the change of the xenon lamp can be easily performed and the lamp assembly can be easily applied to even the existed streetlight.

Further another object of the present invention is to provide a streetlight having a xenon lamp in that a plurality of xenon lamps can be formed at one lamp assembly and the number of each lamp can be controlled, thereby adjusting the brightness thereof and another xenon lamp and ballast can be operated during the damage of the operating xenon lamp, thereby remarkably increasing the period of the lamp change.

Technical Solution

To achieve the above objects of the present invention, there is provided a streetlight comprising: a head having a main socket therein for supplying a power to the lamp assembly; a pillar for supporting the head; a ballast for applying a starting voltage to the main socket mounted into the head; and the lamp assembly comprising a case as a body having a main plug for inserting into the main socket formed at one side of the case, a distribution socket for electrically connecting to the main plug formed at another side of the case, and a space formed at an inside thereof, and a xenon lamp for inserting into the distribution socket.

To achieve the above objects of the present invention, there is provided a streetlight comprising: a head having a main socket therein for supplying a power to the lamp assembly; a pillar for supporting the head; and the lamp assembly comprising a case as a body having a main plug for inserting into the main socket formed at one side of the case, a distribution socket for electrically connecting to the main plug formed at another side of the case, and a space formed at an inside thereof, a xenon lamp for inserting into the distribution socket, and a ballast for receiving a voltage from the main plug and applying a starting voltage to the main socket located in the space.

To achieve the above objects of the present invention, there is provided a streetlight comprising: a head having a main socket therein for supplying a power to the lamp assembly; a pillar for supporting the head; and the lamp assembly comprising a case as a body having a main plug for inserting into the main socket formed at one side of the case, a plurality of distribution sockets for electrically connecting to the main plug formed at another side of the case, and a space formed at an inside thereof, a xenon lamp for inserting into the distribution sockets, and a ballast for receiving a voltage from the main plug and applying a starting voltage to the main sockets located in the space.

Preferably, the lamp assembly further comprises a switching portion for supplying a power to each ballast through the main plug or breaking the power formed at the space of the case.

Preferably, the lamp assembly further comprises a detecting portion for detecting an operating status of the xenon lamp formed at the space of the case and a controller electrically connected to the switching portion, the controller serving to control the switching portion so as to immediately operate another xenon lamp when the controller receives a trouble signal of the operating xenon lamp from the detecting portion.

Preferably, a coloring agent is coated on the inside of a jacket or a colored glass pipe is inserted into a jacket, thereby emitting a desiring color.

Preferably, the xenon lamp is a mercury-free lamp.

Advantageous Effects

As described above, according to the streetlight having the xenon lamp, a lot brighter light can emitted with low power consumption, thereby reducing the energy waste and the ballast can be built in the lamp assembly having the xenon lamp, thereby securing it from a short circuit and easily changing the xenon lamp and ballast.

Especially, the lamp assembly having the xenon lamp can be easily formed at the existed streetlight, thereby reducing the additional cost for change thereof and the plurality of xenon lamps can be formed at one lamp assembly and the number of each lamp can be controlled, thereby adjusting the brightness thereof and another xenon lamp and ballast can be operated during the damage of the operating xenon lamp, thereby remarkably increasing the period of the lamp change.

Also, the mercury-free xenon lamp can be utilized in the present invention, thereby reducing the environmental pollution.

BRIEF DESCRIPTION OF DRAWINGS

The above as well as the other objects, features and advantages of the present invention will be more apparent from the following detailed description taken in conjunction with the accompanying drawings, in which.

BEST MODE FOR CARRYING OUT THE INVENTION

A preferred embodiment of the invention will be described in detail below.

Figure 1:
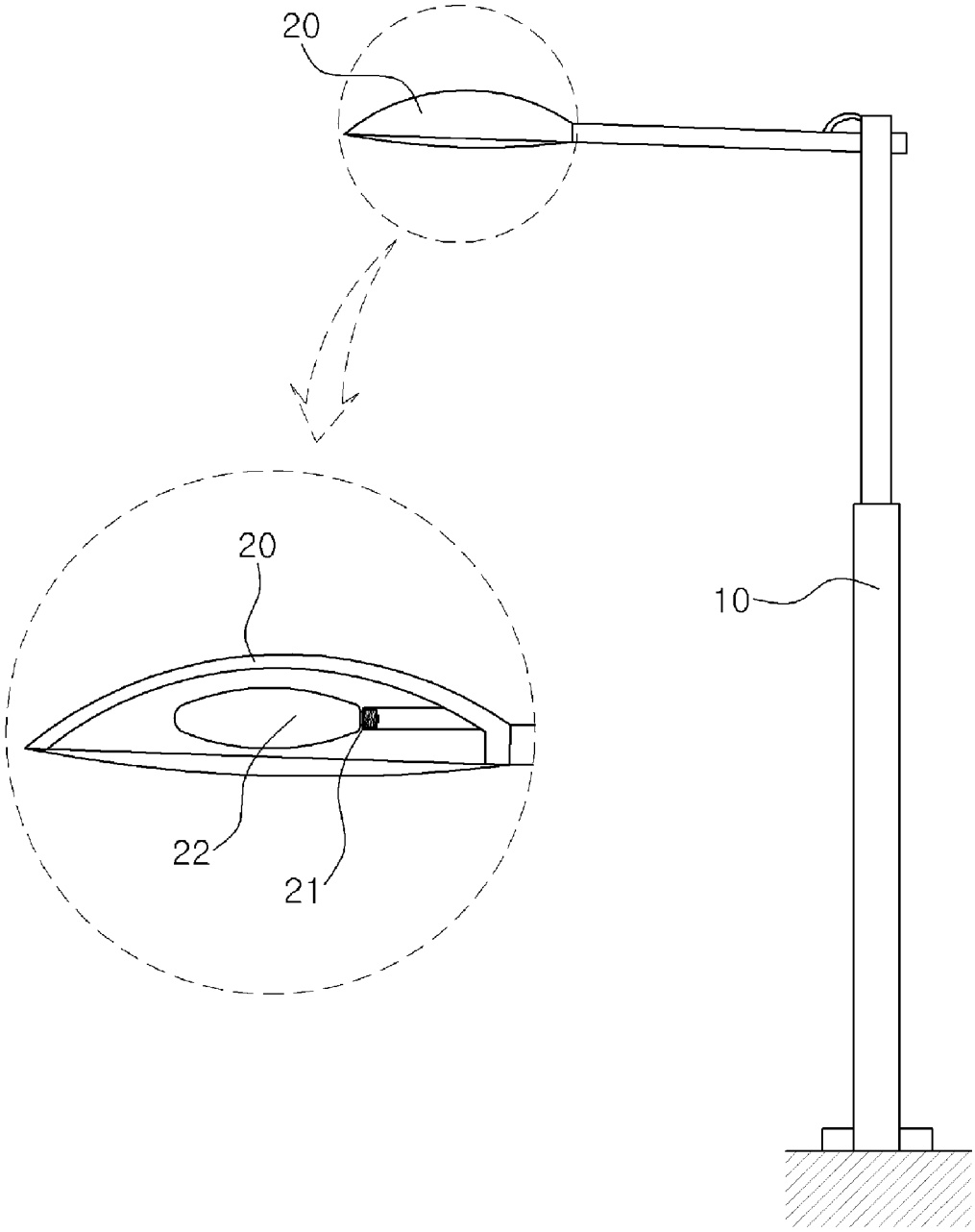
Fig. 1 Prior Art
FIG. 1 is a schematically sectional view illustrating a head and a lamp assembly of a conventional streetlight.

FIG. 1 is a schematically sectional view illustrating a head and a lamp assembly of a conventional streetlight. Referring to FIG. 1, the conventional streetlight includes a head 20 and a pillar 10. The lamp assembly comprises a lamp 22 and a socket 21, which are covered by the head 20. In the conventional streetlight, there exists a need for lowering power consumption and increasing a lamp exchange cycle.

Figure 2:
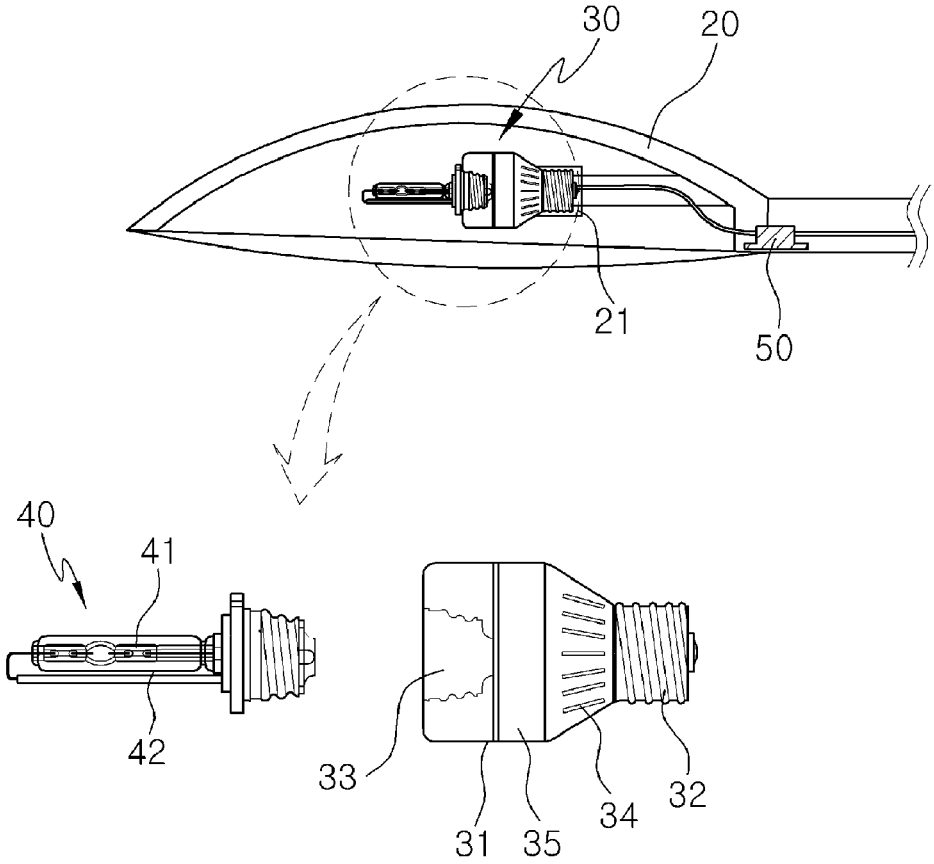
FIG. 2 is a schematically sectional view illustrating a head and a lamp assembly of a streetlight having a xenon lamp according to one embodiment of the present invention.

FIG. 2 is a schematically sectional view illustrating a head and a lamp assembly of a streetlight having a xenon lamp according to one embodiment of the present invention.

As shown in FIG. 2, the streetlight having the xenon lamp according to one embodiment of the present invention includes a lamp assembly 30, a head 20 having a main socket 21 therein for supplying a power to the lamp assembly 30, a pillar for supporting the head 20, and a ballast 50 for applying a high voltage to the main socket 21.

In the conventional streetlight, the halogen lamp is directly coupled to the main socket. However, the streetlight according to the present invention adopts the xenon lamp 40, which is superior to the halogen lamp in terms of luminous intensity and irradiation distance. Accordingly, the streetlight according to the present invention is provided with the lamp assembly 30 capable of easily adopting the xenon lamp 40.

The lamp assembly 30 includes a case 31 as a body having a main plug 32 for inserting into the main socket 21 formed at one side of the case 31, a distribution socket 33 for electrically connecting to the main plug formed at another side of the case 31, an opening 34 formed on the case 31 for ventilation, and a space 35 formed at an inside thereof, and a xenon lamp 40 for inserting into the distribution socket 33. Here, the connecting portion of the xenon lamp 40 is in the form of a slide type connector, so that the xenon lamp 40 is pushed in the distribution socket 33, thereby coupling to each other. Also, the change of the xenon lamp 40 can be easily performed during the damage thereof.

Since a high voltage for starting the xenon lamp 40 should be applied, it needs the ballast 50 for applying a starting voltage to the main socket 21 and controlling the currents applied to the xenon lamp 40.

Here, the ballast 50 can be mounted to the pillar 10. However, it is preferred that the ballast 50 is built in the head 20 so as to be close to the main socket 21.

Figure 3:
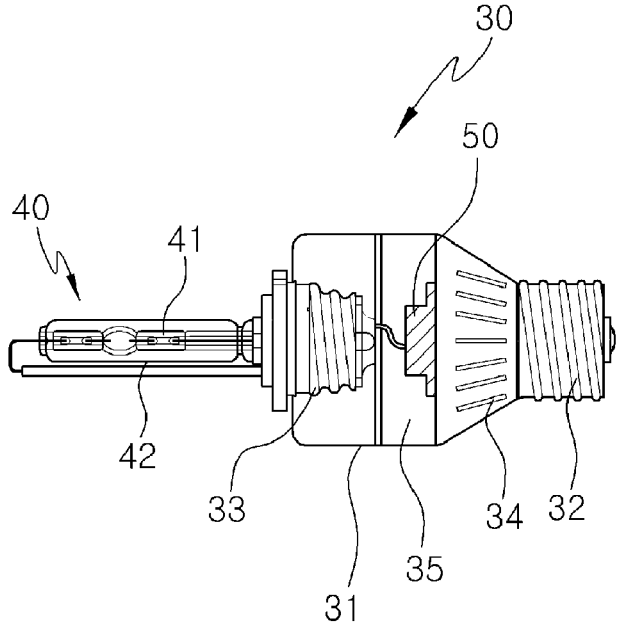
FIG. 3 is a schematically sectional view illustrating a lamp assembly of a streetlight having a xenon lamp according to another embodiment of the present invention.

FIG. 3 is a schematically sectional view illustrating a lamp assembly of a streetlight having a xenon lamp according to another embodiment of the present invention.

As shown in FIG. 3, the lamp assembly 30 according to another embodiment of the present invention includes a case 31 as a body having a main plug 32 for inserting into the main socket 21 formed at one side of the case 31, a distribution socket 33 for electrically connecting to the main plug 32 formed at another side of the case 31, and a space 35 formed at an inside thereof, a xenon lamp 40 for inserting into the distribution socket 33, and a ballast 50 for applying a starting voltage to the main socket 21 and controlling the currents applied to the xenon lamp 40 and located in the space 35.

That is, in the lamp assembly 30 according to another embodiment of the present invention, the ballast 50 is mounted in the space 35.

Accordingly, where the lamp assembly 30 is applied to a new streetlight, the interior structure of the pillar 10 and the head 20 thereof become very simple. Especially, it is unnecessary to form a high-pressure line for connecting the ballast 50 to the main socket 21, thereby preventing the badness of lighting and a short circuit owing to a deterioration of a cable.

Also, where the lamp assembly 30 is applied to even the existed streetlight, it is not difficult to directly connect the power cable to the main socket 21 after it disjoints the ballast 50 formed at the inside of the pillar 10.

Figure 4:
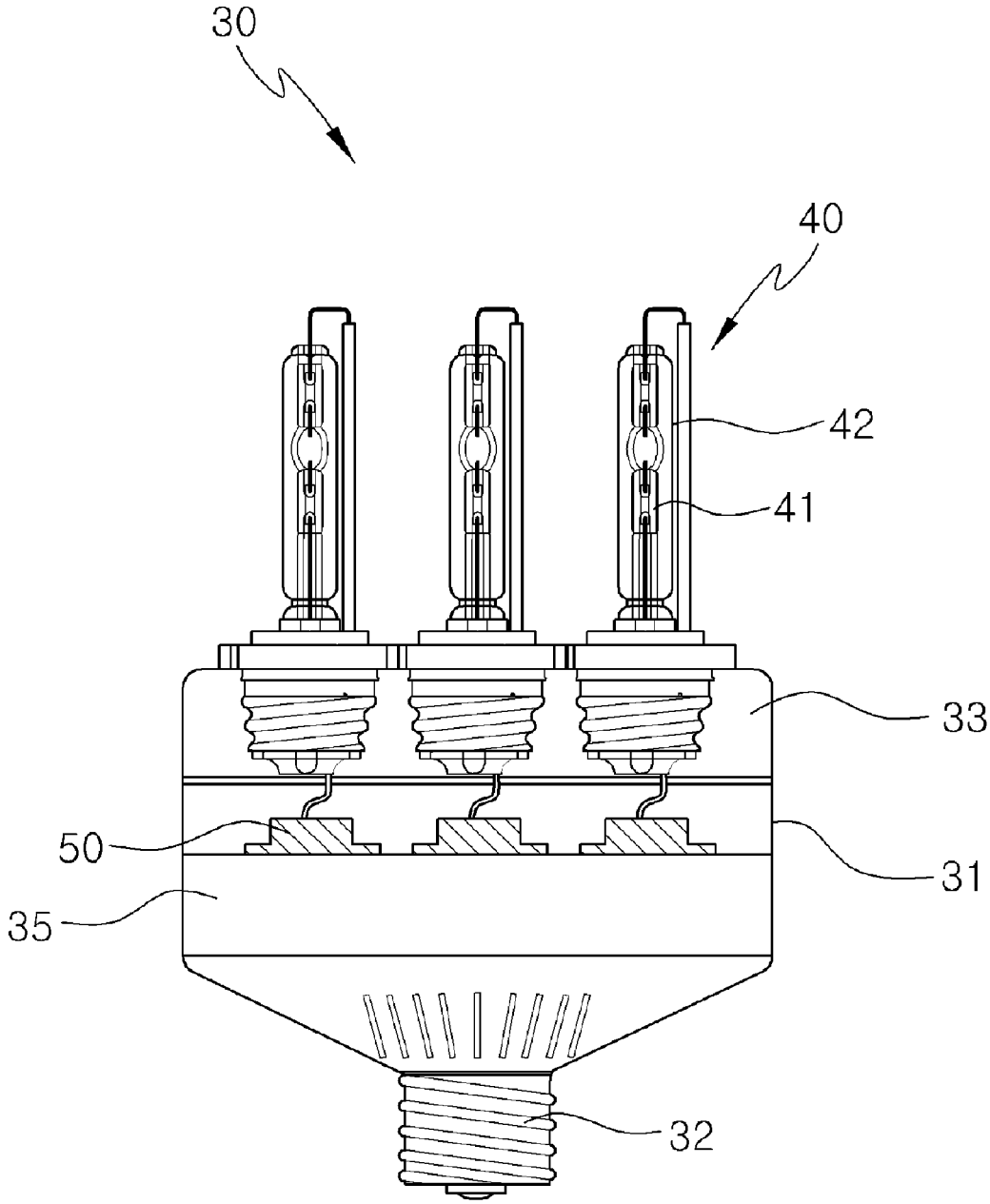
FIG. 4 is a schematically sectional view illustrating a lamp assembly of a streetlight having three xenon lamps according to further another embodiment of the present invention.

FIG. 4 is a schematically sectional view illustrating a lamp assembly of a streetlight having three xenon lamps according to further another embodiment of the present invention.

As shown in FIG. 4, the lamp assembly 30 according to another embodiment of the present invention includes a case 31 as a body having a main plug 32 for inserting into the main socket 21 formed at one side of the case 31, three distribution sockets 33 for electrically connecting to the main plug 32 formed at another side of the case 31, and a space 35 formed at an inside thereof, three xenon lamps 40 for inserting into each distribution socket 33, and three ballasts 50 for applying a starting voltage to the main socket 21 and controlling the currents applied to the xenon lamps 40 and located in the space 35.

It is preferred that each distribution socket 33 may be a straight type or a triangle type. Also, if necessary, the number of the distribution socket 33 may be more than three. However, it is preferred that the number of the distribution socket 33 is blow three in consideration of the installing space and the power capacity thereof.

Here, it is preferred that three ballasts 50 are formed at three distribution socket 33 respectively so as to stabilize the operation of each xenon lamp 40.

Each xenon lamp 40 inserted into three distribution sockets 33 has various power capacities (20 watt through 100 watt). Also, it is necessary to form the ballast 50 suitable for the capacity of each xenon lamp 40.

Also, only one xenon lamp can be utilized in the present invention. However, the plurality of xenon lamps 40 may be utilized according to circumstances.

Figure 5:
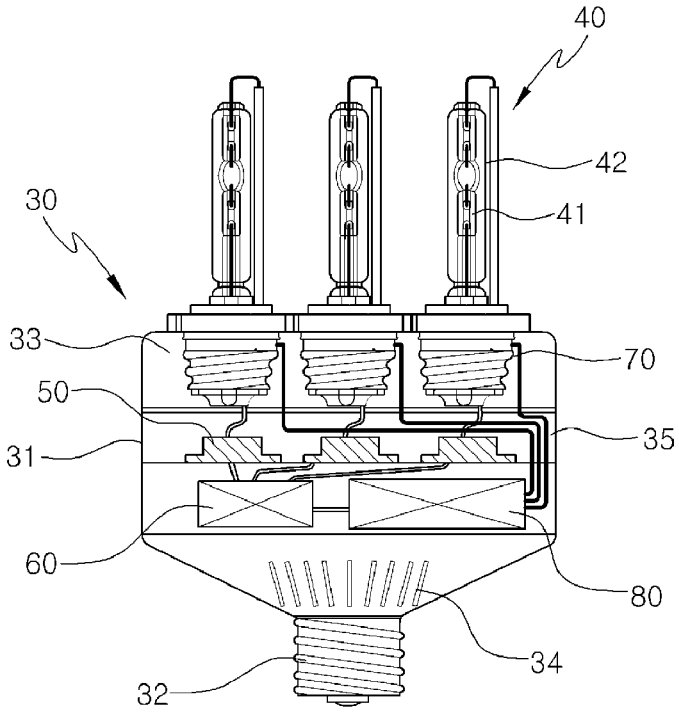
FIG. 5 is a schematically sectional view illustrating a lamp assembly of a streetlight having a switching portion and a controller according to further another embodiment of the present invention.

FIG. 5 is a schematically sectional view illustrating a lamp assembly of a streetlight having a switching portion and a controller according to further another embodiment of the present invention.

As shown in FIG. 5, the lamp assembly 30 according to another embodiment of the present invention further includes a switching portion 60 for supplying the power to each ballast 50 through the main plug 32 or breaking the power formed at the space 35 of the case 31 shown in FIG. 4.

Also, a controlling module (not shown) is electrically connected to each xenon lamp 40 and electrically interlocked to the switching portion 60, so that it can adjust the xenon lamps 40.

Here, it can ordinarily use one lamp 40 among three xenon lamps. However, two or three xenon lamps 40 can be operated according to circumstances.

Moreover, lamp assembly 30 according to another embodiment of the present invention further includes a detecting portion 70 for detecting the operating status of the xenon lamp 40 formed at the space 35 of the case 31 and a controller 80 electrically connected to the switching portion 60.

A relationship among the switching portion 60, the detecting portion 70, and the controller 80 will be described below in case of operating only one xenon lamp 40.

Firstly, the controller 80 allows the power to be supplied to one xenon lamp 40 though the control of the switching portion 60, so that the corresponding xenon lamp 40 can be operated by means of the voltage boosted through the ballast 50.

Here, the detecting portion 70 interlocked with each xenon lamp 40 detects as to whether the xenon lamp 40 is normally operated or not and then, allows the detected signal to be transmitted to the controller 80.

Where the operating xenon lamp 40 is damaged, the controller 80, which receives the detected signal from the detecting portion 70, serves to control the switching portion 60 so as to operate another xenon lamp 40 (for example, previously setting up toward clockwise rotation in terms of operation order)

Besides, where only two xenon lamps among three lamps 40 are operated, it can be equally applicable. Also, the controlling module (not shown) interlocked to the controller 80 is formed at the outside of the case 31, so that it can adjust the number of the operating xenon lamps 40.

Generally, the xenon lamp 40 includes a tube 41 for inserting the xenon gas therein and generating electric discharge and a jacket 42 of a pipe type for protecting the tube 41.

Here, a metal is inserted into the tube 41 for electrical discharging. Also, the color of emitting light can be varied according to the kind of the metal.

However, since the number of the color thereof is a few, a coloring agent is coated on the inside of the jacket 42 or a colored glass pipe is inserted into the jacket 42, thereby emitting a desiring color. Also, the light having a color suitable for the establishment place of the streetlight can be emitted, thereby raising aesthetic appreciation.

Generally, the ingredient of the metal for improving the brightness of the xenon lamp 40 may be a mercury. However, a mercury-free xenon lamp can be utilized in the present invention. Accordingly, it can provide an environment-friendly xenon lamp.

Figure 6:
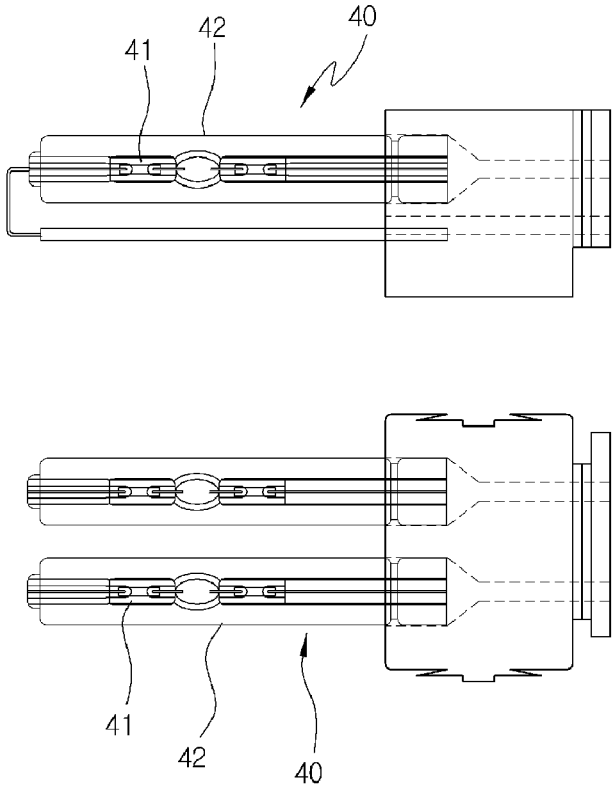
FIG. 6 is schematically front and planar views illustrating a xenon lamp of a streetlight according to further another embodiment of the present invention.
Figure 7:
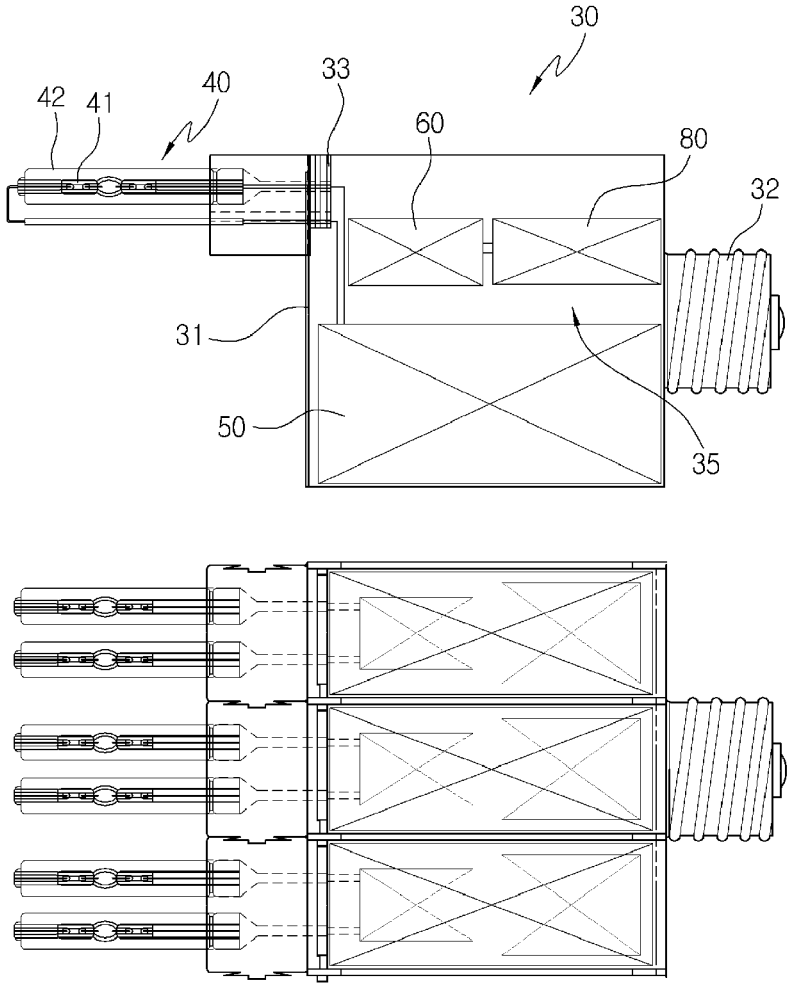
FIG. 7 is schematically front and planar views illustrating a lamp assembly according to further another embodiment of the present invention.
Figure 8:
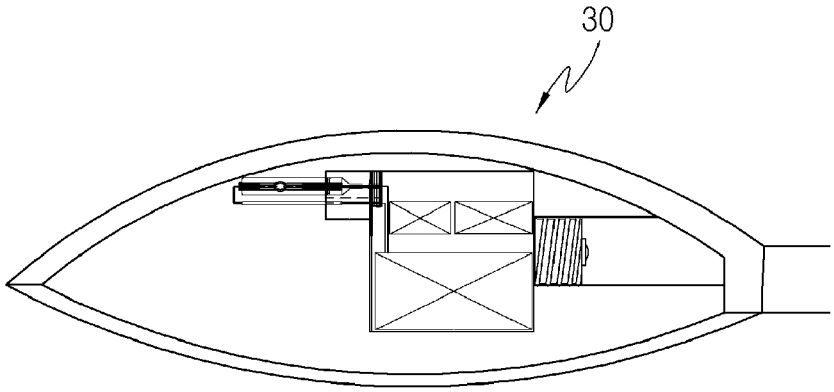
FIG. 8 is a schematically sectional view illustrating a head of a streetlight having a lamp assembly according to further another embodiment of the present invention.

FIG. 6 is schematically front and planar views illustrating a xenon lamp of a streetlight according to further another embodiment of the present invention, FIG. 7 is schematically front and planar views illustrating a lamp assembly according to further another embodiment of the present invention, and FIG. 8 is a schematically sectional view illustrating a head of a streetlight having a lamp assembly according to further another embodiment of the present invention.

As shown in FIG. 6, the xenon lamp 40 includes two jacket 43, thereby emitting a lot brighter light.

As shown in FIG. 7 and FIG. 8, the lamp assembly can be formed in the type of various shapes, differently with that of FIG. 4 and FIG. 5.

Industrial Applicability

The present invention relates to a streetlight having a xenon lamp and more particularly, to a streetlight having a xenon lamp in that a lamp assembly having a xenon lamp is formed at the existed streetlight, whereby lowering a power consumption and remarkably increasing the period of the lamp change.

While this invention has been described in connection with what are presently considered to be the most practical and preferred embodiments, it is to be understood that the invention is not limited to the disclosed embodiments and the drawings, but, on the contrary, it is intended to cover various modifications and variations within the spirit and scope of the appended claims.

The invention claimed is:

1. A streetlight comprising:

a head having a main socket therein for supplying a power to the lamp assembly;

a pillar for supporting the head;

a ballast for applying a starting voltage to the main socket mounted into the head; and the lamp assembly comprising a case as a body having a main plug for inserting into the main socket formed at one side of the case, a distribution socket for electrically connecting to the main plug formed at another side of the case, and a space formed at an inside thereof, and a xenon lamp for inserting into the distribution socket.

2. A streetlight comprising:

a head having a main socket therein for supplying a power to the lamp assembly;

a pillar for supporting the head; and the lamp assembly comprising a case as a body having a main plug for inserting into the main socket formed at one side of the case, a distribution socket for electrically connecting to the main plug formed at another side of the case, and a space formed at an inside thereof, a xenon lamp for inserting into the distribution socket, and a ballast for receiving a voltage from the main plug and applying a starting voltage to the main socket located in the space.

3. A streetlight comprising:

a head having a main socket therein for supplying a power to the lamp assembly;

a pillar for supporting the head; and the lamp assembly comprising a case as a body having a main plug for inserting into the main socket formed at one side of the case, a plurality of distribution sockets for electrically connecting to the main plug formed at another side of the case, and a space formed at an inside thereof, a xenon lamp for inserting into the distribution sockets, and a ballast for receiving a voltage from the main plug and applying a starting voltage to the main sockets located in the space.

4. A streetlight as claimed in claim 3, wherein the lamp assembly further comprises a switching portion for supplying a power to each ballast through the main plug or breaking the power formed at the space of the case.

5. A streetlight as claimed in claim 4, wherein the lamp assembly further comprises a detecting portion for detecting an operating status of the xenon lamp formed at the space of the case and a controller electrically connected to the switching portion, the controller serving to control the switching portion so as to immediately operate another xenon lamp when the controller receives a trouble signal of the operating xenon lamp from the detecting portion.

6. A streetlight as claimed in claim 1, wherein a coloring agent is coated on the inside of a jacket or a colored glass pipe is inserted into a jacket, thereby emitting a desiring color.

7. A streetlight as claimed in claim 1, wherein the xenon lamp is a mercury-free lamp.

8. A streetlight as claimed in claim 2, wherein a coloring agent is coated on the inside of a jacket or a colored glass pipe is inserted into a jacket, thereby emitting a desiring color.

9. A streetlight as claimed in claim 2, wherein the xenon lamp is a mercury-free lamp.

10. A streetlight as claimed in claim 3, wherein a coloring agent is coated on the inside of a jacket or a colored glass pipe is inserted into a jacket, thereby emitting a desiring color.

11. A streetlight as claimed in claim 3, wherein the xenon lamp is a mercury-free lamp.

* * * * *